United States Patent [19]

Newsom et al.

[11] 4,037,660

[45] July 26, 1977

[54] METHOD FOR STEAM CLEANING LINERS IN OIL WELL BORES

[75] Inventors: William D. Newsom; James R. Carnahan, both of Bakersfield, Calif.

[73] Assignee: K. R. Evans & Associates, Bakersfield, Calif. ; a part interest

[21] Appl. No.: 473,697

[22] Filed: May 28, 1974

[51] Int. Cl.[2] ..... E21B 37/00

[52] U.S. Cl. ..... 166/302; 15/316 R; 134/5; 166/304; 239/DIG. 13

[58] Field of Search ..... 15/316, 406; 134/22 C, 134/24, 167 C, 168 C, 169 C, 5, 30; 137/15; 166/74, 143, 158, 222, 223, 302, 303, 304, 312, 315; 239/DIG. 13, 135

[56] References Cited

U.S. PATENT DOCUMENTS

| | | | |
|---|---|---|---|
| 193,838 | 8/1877 | West | 166/302 |
| 331,691 | 12/1885 | Duennisch | 239/DIG. 13 |
| 1,400,765 | 12/1921 | Pallette | 166/57 |
| 1,436,058 | 11/1922 | Smith et al. | 166/57 |
| 1,439,560 | 12/1922 | Lee | 166/303 |
| 2,680,487 | 6/1954 | Carpenter | 166/55.1 |
| 2,802,537 | 8/1957 | Goldinger | 166/224 |
| 2,852,078 | 9/1958 | Krause | 166/223 |
| 2,929,451 | 3/1960 | Hurlstone | 166/303 |
| 3,011,549 | 12/1961 | Fredd et al. | 166/312 |
| 3,240,273 | 3/1966 | Solari et al. | 166/312 |
| 3,251,416 | 5/1966 | Kiel | 166/312 |
| 3,369,606 | 2/1968 | Troeller | 166/312 |
| 3,402,967 | 9/1968 | Edmonds et al. | 166/223 |
| 3,547,191 | 12/1970 | Malott | 166/223 |
| 3,583,488 | 6/1971 | Hutchison | 166/303 |
| 3,662,828 | 5/1972 | Hutchison | 166/312 |
| 3,791,449 | 2/1974 | Cochran | 166/315 |
| 3,818,986 | 6/1974 | Abney et al. | 166/143 |
| 3,850,241 | 11/1974 | Hutchison | 166/222 |

FOREIGN PATENT DOCUMENTS

| | | | |
|---|---|---|---|
| 495,832 | 9/1953 | Canada | 166/312 |

*Primary Examiner*—Ernest R. Purser
*Attorney, Agent, or Firm*—Head, Johnson & Chafin

[57] ABSTRACT

Method and means for steam cleaning subsurface liners in oil well bores and the like, comprising steam head means particularly designed and constructed for radially spreading a steam stream through a substantially constant area or volume from the stream to the proximity of the releasing jet area in order to maintain the steam at maximum heat upon the release thereof into the area being steam treated. The steam head may be initially introduced into the well bore by a tubing string, lowered to a position in the proximity of the liner by the tubing string, released from the tubing string and moved downwardly through the liner by a smaller tubing string, wire line or the like, and reciprocated within the liner by the smaller tubing string or wire line for cleaning of the liner.

6 Claims, 4 Drawing Figures

METHOD FOR STEAM CLEANING LINERS IN OIL WELL BORES

BACKGROUND OF THE INVENTION

1. Field of the Invention

This invention relates to improvements in steam cleaning devices and methods and more particularly, but not by way of limitation, to a method and means for steam cleaning subsurface liners in an oil well bore or the like.

2. Description of the Prior Art

It is common practice today to install a perforated sleeve, usually called a liner, below the well casing and in the general area of the producing formation or formations in a producing oil well and the like. The well fluid enters the bottom or lower portion of the well bore through the perforations of the liner and accumulates therein from whence it is elevated to the surface of the well by pumping, or other conventional means in order to retrieve the well fluid from the well bore. Most of the well fluids contain heavy elements, such as asphalt, and the like, which are difficult to elevate to the surface of the well. These constituents usually form or accumulate on the inner and outer periphery of the liner and frequently greatly reduce the internal diameter of the liner and many times completely seal off or close the liner perforations. Many oil wells have been shut down under these conditions since it becomes substantially impossible to recover any additional well fluid from the subsurface producing formation.

Steam has been widespread in use for reducing the accumulation of these heavy residuals on the liner or for cleaning the liner in order that the well's produced fluid may be increased or reinstituted. However, many of the present day devices and methods of applying steam to the subsurface liner have disadvantages in that it is difficult to maintain the temperature of the steam sufficiently high to be efficient in a steam cleaning operation. In addition, it is frequently difficult to install and operate the steam cleaning apparatus from the surface and down the well for performing the cleaning operation. In addition, many of these devices are hazardous in that the operating personnel may be injured by the steam being used in the cleaning operation.

SUMMARY OF THE INVENTION

The present invention contemplates a novel method and means for steam cleaning liners in oil well bores and the like. The steam head in and of itself is particularly designed and constructed for maintaining a maximum temperature for the steam at the jet area thereof. This is accomplished by passing the steam stream radially outwardly by a steam spreading operation wherein the cross sectional area or volume of the steam is maintained substantially constant until the steam is released therefrom. Thus, the pressure of the steam stream is maintained substantially constant for precluding or reducing temperature reduction. Thus, the steam jetted against the inner periphery of the liner and liner slots (or directly against a subsurface formation) is at a maximum temperature for assuring an efficient steam cleaning operation.

In addition, the apparatus is designed and constructed for facilitating the lowering of the steam head through the well bore and into the proximity of the liner or producing formation in the well bore. The steam head is releasably secured to the lower end of a tubing string, and subsequent to the removal of the production equipment from the well bore and cleaning of the liner with a bail and/or scraper, the tubing string may be lowered into the well bore until the lower end of the tubing is just above the interval to be cleaned. A second tubing string of a smaller diameter than the first tubing string may then be run into the first tubing string for connection with the upper end of the steam head, said second tubing being of a length approximately 20 feet longer than the overall length of the liner. When the second tubing has been connected with the steam head, a suitable packer head may be installed between the first and second tubing strings, and the steam head may be released from its connection with the first tubing string. The steam head may then be lowered through the liner to the proximity of the lower end thereof and steam be directed downwardly through the annular space between the first and second tubing strings. Cage means is provided in the second tubing string above the packer head and the steam is directed into the interior of the second tubing string at this point for passage to the steam head. The steam is forced radially outwardly from the steam head for impinging against the inner periphery of the liner and liner slots or subsurface formation and as the steam is discharged from the steam head, the steam head may be reciprocated within the liner for applying the heat and pressure of the steam along substantially the entire length of the liner. Of course, subsequent to the cleaning operation, the cleaning equipment may be removed from the well bore and the well returned to production. The novel steam cleaning method and means is simple and efficient in operation and economical and durable in construction, and incorporates maximum safety to operating personnel at the surface of the well.

DESCRIPTION OF THE PREFERRED EMBODIMENTS

Figure 4:
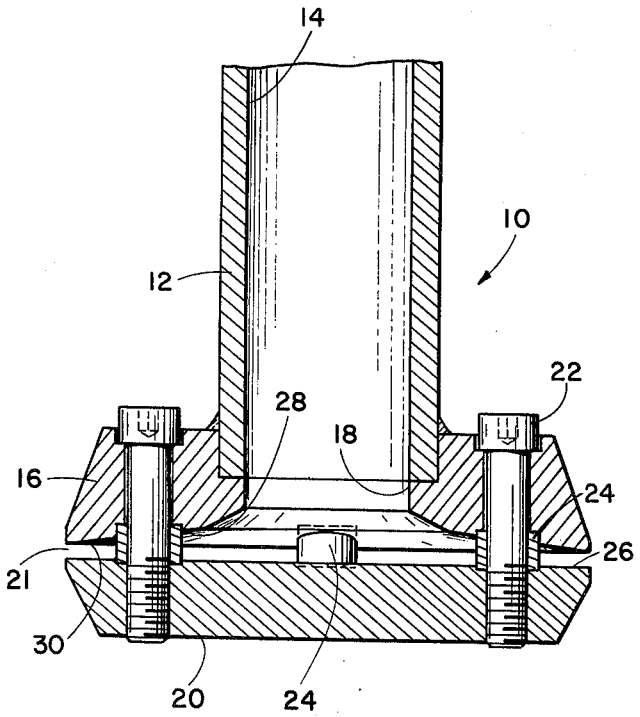
FIG. 4 is a sectional elevational view of a steam cleaning head embodying the invention.

Referring to the drawings in detail and particularly FIG. 4, reference character 10 generally indicates a steam head comprising a centrally disposed sleeve 12 having a longitudinal fluid passageway 14 extending therethrough. An annular flange 16 is welded or otherwise rigidly secured to one end of the sleeve 12 and is provided with a central aperture 18 of a diameter or cross sectional area substantially equal to the diameter or cross sectional area of the passageway 14 and disposed in alignment therewith. A circular plate 20 is secured to the flange 16 in any well known manner, such as by a plurality of circumferentially spaced threaded studs 22 having spacer sleeves 24 disposed therearound and interposed between the plates 20 and flange 16 for maintaining the plate 20 spaced from the flange 16 in a manner providing a continuous opening r hiatus 21 therebetween and for a purpose as will be ereinafter set forth. The surface 26 of the plate 20 hich is in the proximity of the flange 16 is preferably ibstantially flat and any fluid, such as steam, moving irough the passageway 14 in a direction toward the ate 20 impinges against the surface 26 and is spread or rectly radially outwardly thereby as is well known.

The outer face or surface 28 of the flange 16, which is sposed in the proximity of the plate 20 is of a substanally horn-typed configuration, the cross sectional conguration of which has been particularly selected to aintain a constant cross sectional area or volume from e passageway 14 and bore 18 to the point 30 spaced ightly radially inwardly from the outer periphery of e hiatus 21. For example, in a head 10 to be used ithin a 5½ diameter liner, the contour of the surface 28 ay be calculated as follows to maintain a constant area 1.77 square inches at any radius:

| Diameter In inches) | Radius (in inches) | distance between surfaces 26 and 38 (in inches) |
|---|---|---|
| 1.50 | 0.75 | .376 |
| 2.00 | 1.00 | .281 |
| 2.50 | 1.25 | .225 |
| 3.00 | 1.50 | .1875 |
| 3.50 | 1.75 | .1605 |
| 4.00 | 2.00 | .141 |
| 4.50 | 2.25 | .125 |
| 4.70 | 2.35 | .1195 |

sing the calculations set forth above, an optimum ontour for the surface 28 may be plotted and as a pracal matter for purposes of fabrication the contour may machined or otherwise constructed in a manner most osely approximating the ideal curve. As a practical atter, in a 5½ head, it has been found that the angular sposition of the surface 28 from the passageway 14 rough a radius of 0.075 inches from the longitudinal nter thereof to a radius of 1.17 inches is preferably wnward at 69° from the vertical or 21° from the rizontal. From the radius of 1.17 inches to a radius of 30 inches, the angular disposition of the surface 28 is eferably 83½° downward from the vertical or 6½° om the horizontal. From the radius of 2.30 inches to a dius of 2.35 inches the surface 28 is substantially paral to the horizontal, or parallel with the surface 26 and tends thus to the outer periphery of the hiatus 21. ius, the area or volume through which the steam sses is maintained substantially constant from the ssageway 14 and bore 18 to the point 30. The temperre and pressure of the steam is maintained substanlly constant by maintaining this constant area or volie until just before the steam is released through the itus 21. Of course, upon release from the hiatus 21, the am moves radially outwardly from the head 10 at eat force and a high temperature for a purpose as will hereinafter set forth.

The steam head 10 is adapted to be lowered within an well bore, or the like, in a manner as will be hereinaf set forth and is connected with a source of steam, as ll be hereinafter set forth for impinging the steam ainst the sidewalls of the well bore at high pressure d temperature in order to remove unwanted or undeable accumulations of material from the well bore in der to improve the production of the well fluid. The eam of steam is directed downwardly to the steam ad 10 and through the passageway 14 for impinging ainst the surface 26 of the plate 20. The surface 26 erts the steam radially outwardly through the area tween the surfaces 26 and 28, maintaining a substantially constant cross sectional area or volume for the passage of the steam until the point 30, as hereinbefore set forth. Of course, the release of the steam from the hiatus 21 may slightly reduce the pressure and temperature thereof, but since the pressure and temperature have been maintained at a maximum until just before the release thereof, the pressure and temperature of the released steam will be much greater than otherwise possible, thus producing increased efficiency in results.

Figure 1:
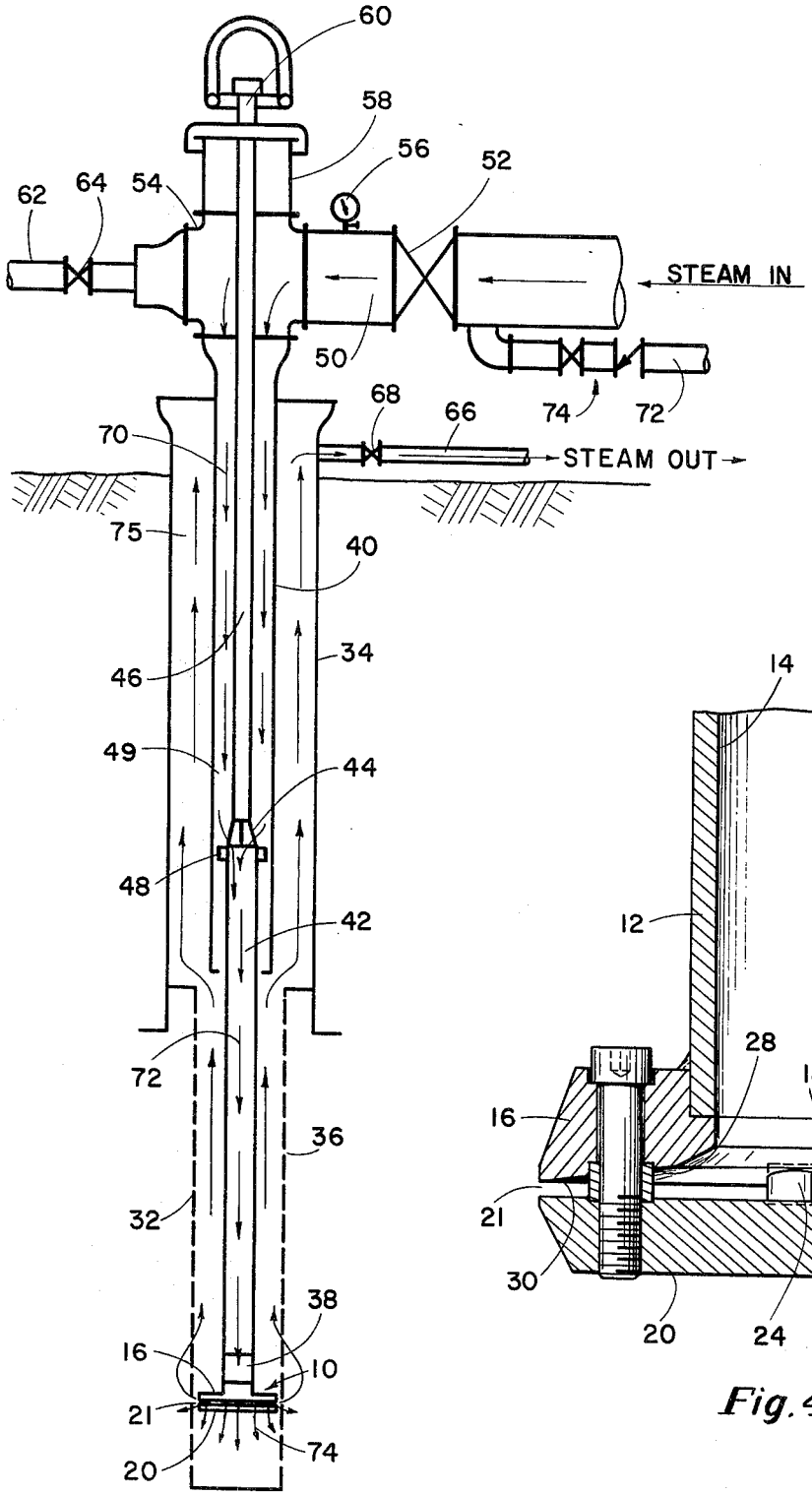
FIG. 1 is a schematic sectional elevation view of a well bore having cleaning apparatus embodying the invention disposed therein and illustrates one form of the cleaning method.

Referring now to FIG. 1, one method of the invention is depicted wherein a suitable liner 32 has been installed in a producing well bore in the usual manner and is normally disposed below the well casing 34 and in the proximity of the producing subsurface formation. The liner 32 is usually provided with a plurality of circumferentially and longitudinally spaced perforations 36 for admitting the well fluid into the bottom of the well bore. In many instances, the perforations become clogged in such a manner that the flow of incoming fluid is restricted and in some instances is completely precluded. In addition, heavy components of the well fluid, such as asphalt frequently adhere or accumulate on the inner and/or outer peripheries of the liner 34 and the accumulated components on the inner periphery thereof greatly reduces the diameter of the flow passageway through the liner, thus further restricting the flow of the well fluid to the surface of the well bore. When this condition occurs, it is desirable to clean the liner 32 in a manner for removing the accumulation of materials on the sidewalls of the liner and for opening the perforations 36.

In order to steam clean the liner 32 in accordance with the embodiment of the invention depicted in FIG. 1, the usual production equipment (not shown) normally present in the well bore during production of well fluid therefrom is pulled or removed from the well bore in any suitable or well known manner (not shown). It is then preferable to bail clean the casing 34 and liner 32 in the usual manner (not shown) and to run a suitable scraper and/or impression block (not shown) through the liner 32, as is well known.

A suitable nipple or coupling 38 is preferably threadedly or otherwise secured to the sleeve 12 of the steam head 10. The nipple 38 is preferably of any well known type having a suitable J-key or J-lock member (not shown) and a suitable cross-over connection for connection with at least two different tubing sizes. The head 10 and nipple 38 are then connected to the bottom or lower end of a first tubing string 40 having a suitable J-slot (not shown) provided on the lower end thereof for connection with the J-key or J-lock of the nipple 38. The tubing string 40 having the steam head 10 secured thereon may then be lowered through the casing 34 in any well known manner (not shown), stopping or landing the tubing 40 with the lower end thereof just above the interval to be cleaned. It is preferable that the J-locks with left hand thread up, but not limited thereto.

A second tubing string 42 of a diameter less than the diameter of the tubing string 40 may then be lowered through the tubing 40 and connected with the nipple 38 in the usual manner. The tubing 42 is preferably of a length substantially equal to the length of the liner 32 plus 20 feet. When the tubing 42 has been connected with the nipple 38, the connection between the nipple 38 and the first tubing 40 may be released. The upper end of the second tubing string 42 is preferably provided with a suitable open cage 44, and may be connected to suitable coupling rods 46 which are particularly designed for running through a packing head, as is well known. A suitable diverter 48 is provided on the outer periphery of the tubing 42 below the cage 44 in any well known manner (not shown) and constricts the annulus 49 between the rods 46 and tubing 40. The coupling rods 46, tubing 42 and steam head may then be lowered in the well bore until the steam head is disposed within the liner 32 below the casing 34.

There is normally a great supply of steam available at the site of a producing oil well and a suitable conduit 50 at the surface of the well may be connected with a source of steam (not shown) through a suitable valve 52 and in any well known manner (not shown). The conduit 50 is in communication with the interior of the tubing string 40 through a suitable fitting 54 connected at the upper end of the tubing 40. In addition, it is preferable to provide a suitable pressure gauge 56 in the line or conduit 50 for ascertaining the pressure therein as is well known and a pack-off head stuffing box 58 is connected at the upper end of the fitting 54 as is well known for receiving the usual polished rod 60 therethrough, which in turn is connected to the upper end of the coupling rods 46. The pack-off head 58 is preferably set or installed subsequent to releasing of the head 10 from the connection with the tubing 40 and prior to lowering of the head 10 into the liner 32. The usual tubing blow-down conduit 62 is also connected to the fitting 54 through a suitable valve 64 and a similar casing blow-down conduit 66 is connected with the casing 34 and in communication with the interior thereof through a suitable valve 68, as is well known. Of course, the upper end of the casing 34 is suitably sealed around the tubing 40 in any well known manner.

When the steam head 10 has been lowered into the liner 32 as hereinbefore set forth the valve 52 may be opened for admitting a flow of steam into the tubing 40 for flow downwardly therethrough in the annulus 49 between the tubing 40 and the coupling rods 46, as indicated by the arrows 70. Of course, a suitable flow line 72 may be in communication with the interior of the steam conduit 50 through suitable valving generally indicated at 74 in order that additives may be mixed with the steam, such as detergents, lubricants, or the like, if desired. It is preferable to admit the steam into the tubing 40 slowly, building up to cleaning rate over a short period of time with the casing blow-down line 66 open.

The diverter 48 restricts or reduces the clearance in the annulus 49 below the cage 44 and diverst the flow of the steam through the cage 44 and into the interior of the tubing string 42 as indicated by the arrows 72. The steam is directed downwardly through the tubing 42 into the steam head 10, and impinges against the surface 26 of the plate 20 as hereinbefore set forth. The steam is then dispersed through the hiatus or jet releasing area around the outer periphery of the head 10 as indicated by the arrows 74. The steam is ejected from the head 10 at high pressure and temperature and impinges against the inner periphery of the liner 32 with great force. The steam then returns to the surface of the well in the annulus 75 between the tubing 40 and casing 34 as indicated by the arrows 76.

The head 10 may now be reciprocated over approximately a 25 foot interval for approximately 25 minutes. Of course, it is preferable to pull the tubing 42 and lower the tubing 42 slowly during the reciprocating of the head 10 in the liner 32. The steam may then be closed off from the well tubing 40 and additional coupling rods may be connected into the coupling rod string 46 in the usual manner. The steam may then be introduced into the tubing 40 again and the reciprocation of the steam head 10 may be repeated in another linear portion of the liner 32. The operation may be repeated until the entire liner 32 has been efficiently cleaned.

When the entire length of the liner 32 has been cleaned the cleaning equipment may be pulled from the well bore by substantially reversing the installation procedure. The steam head 10 may be elevated or raised within the well bore into connection with the lower end of the tubing 40 by the J-lock or J-key connection therebetween. The tubing 40 may then be pulled from the well bore and of course the head 10 is removed from the well bore simultaneously therewith. The production equipment (not shown) may be replaced or reinstalled in the well bore in the usual manner and production of fluid from the well may be continued as is well known.

Figure 2:
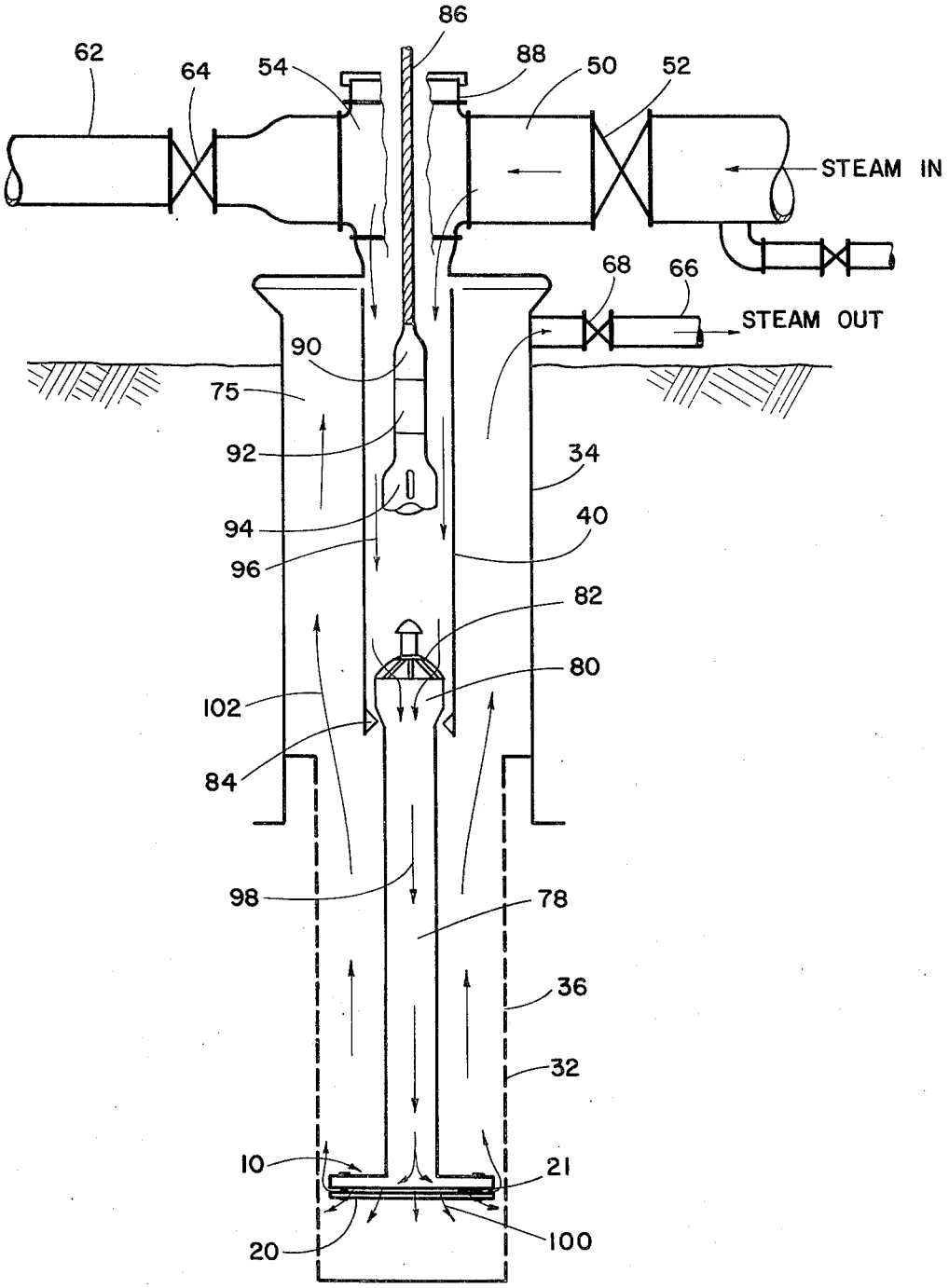
FIG. 2 is a view similar to FIG. 1 showing a modified form of the cleaning method embodying the invention.

Referring now to FIG. 2, a modified method of cleaning the liner 32 is shown wherein the production equipment (not shown) is pulled from the well bore prior to a steam cleaning operation as hereinbefore set forth and the tubing 40 is set or lowered into the casing 34 generally similar as that set forth in the prior embodiment with the lower end of the tubing being landed just above the interval to be cleaned. However, the steam head 10 is suitably connected to or carried by a nonupset inner tubing string 78 of an outer diameter less than the inner diameter of the tubing 40. The inner tubing string 78 extends longitudinally in the tubing 40 and is provided with a suitable latchon neck 80 such as that known as a "Reese" type latch-on neck and having an open pump type cage 82 on the upper end thereof. A suitable beveled collar and seat assembly 84 is provided on the lower end of the tubing string 40 and supports the latchon neck 80 in order to suspend the inner tubing 78 and steam head 10 in the well bore during lowering and landing of the tubing string 40 therein. Of course, it is preferable that the length of the inner tubing 78 be somewhat longer than the length of the liner 32 to be cleaned, but not limited thereto.

When the tubing 40 has been installed in the casing 34, a special smooth wrapped wire line 86 may be lowered into the well bore through a suitable packing head 88 secured to the fitting 54 in any well known manner (not shown). The packing head 88 is preferably a hydraulic lubricator designed for use with particularly high temperature, as is well known. A suitable swab rope socket member 90 is secured to the lower end of the wire line 88 for securing a suitable swab sinker bar 92 and a suitable "on-off" adapter 94 thereon. The on-off adapter 94 is preferably a "Reese" type adapter complementary to the latchon neck 80 and when the wire line 86 is lowered through a sufficient distance in the tubing 40 the adapter 94 will engage the latchone neck 80 as is well known. The wire line may then be alternately raised and lowered within the tubing 40 in order to reciprocate the steam head 10 within the liner 32 in the manner as hereinbefore set forth.

Of course, steam is admitted into the tubing 40 through the steam line 50 and the steam moves downwardly through the tubing 40 as indicated by the arrows 96. The latchon neck 80 restricts the annulus between the inner tubing 78 and the tubing 40 and the steam enters the inner tubing 78 through the open cage 82 and moves downwardly through the tubing 78 as indicated by the arrows 98. The steam is ejected from the steam head 10 through the hiatus 21 and is impinged against the inner periphery of the liner 32 as indicated by the arrows 100. The "spent" steam flows upwardly through the casing in the annular space 74 between the tubing 40 and the casing 34 as indicated by the arrows 102.

Subsequent to the complete cleaning of the liner 32 by reciprocation of the steam head 10 therein as hereinbefore set forth, the on-off adapter 80 may be disconnected from the latchon neck 80 in the usual manner whereby the beveled collar and seat assembly 84 will support the latchon neck 80 and inner tubing 78 in the well bore. The wire line and elements connected thereto may then be removed from the well bore in the usual manner, and the tubing string 40 may be removed from the well casing 34 in any suitable manner, pulling the tubing 78 and steam head 10 from the well simultaneously therewith. The production equipment may then be replaced within the well and production may be commenced in the usual manner.

In some instances it may be desirable to set a suitable packer (not shown) between the tubing 40 and the well casing 34 to thus off return of the steam to the surface of the well for minimizing heat expansion damage to the casing in older wells. In addition, a suitable swab cup, or the like (not shown), may be disposed around the outer periphery of the tubing 78 above the steam head 10 for diverting a greater quantity of the steam directly onto the liner 32.

Figure 3:
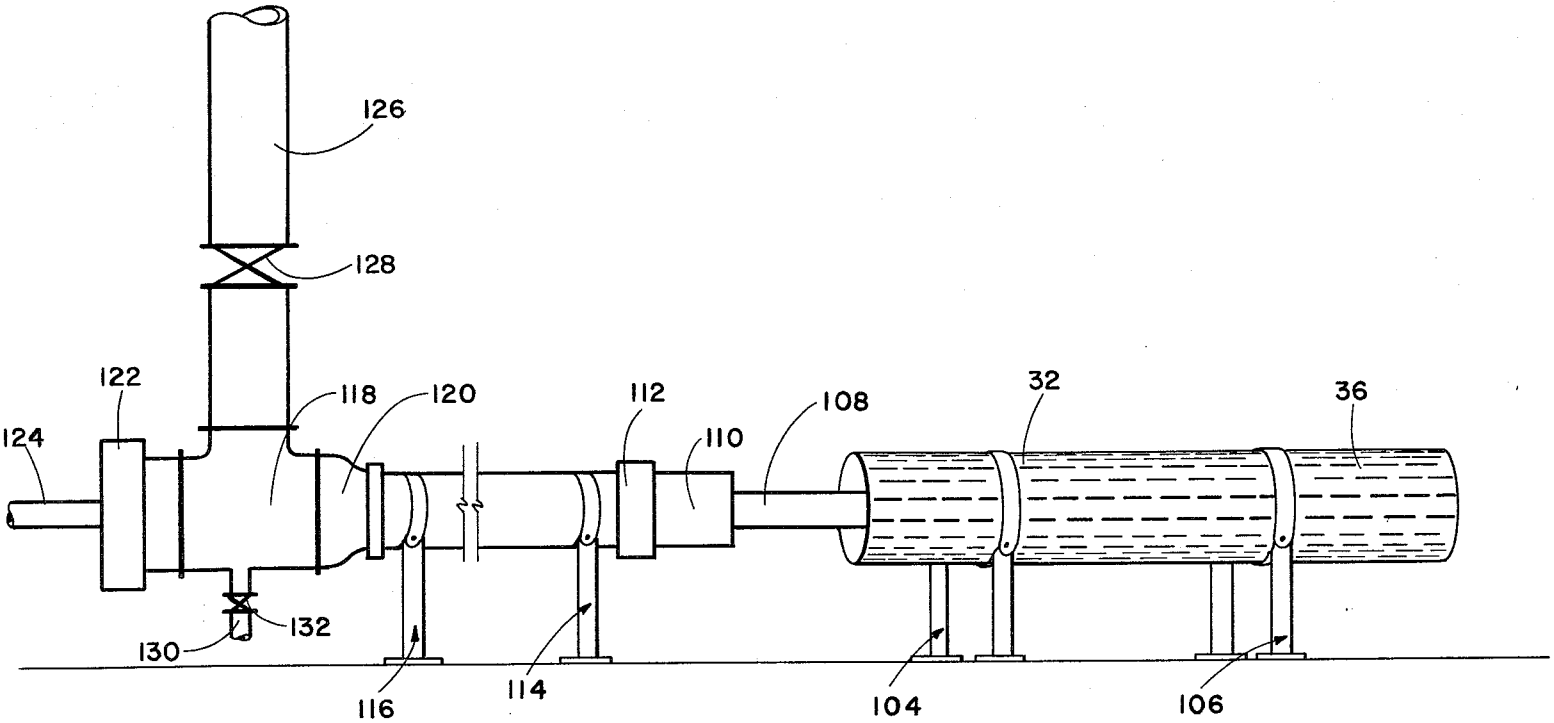
FIG. 3 is a side elevational view depicting a cleaning method embodying the invention and particularly illustrating cleaning of an oil well liner which has been removed from a well bore.

Referring now to FIG. 3, still another method of cleaning the liner 32 is depicted wherein the liner 32 has been removed from the well bore. The liner 32 may be supported in a substantially horizontal position in any suitable manner, such as by a plurality of spaced supports 104 and 106. The steam head 10 (not shown in FIG. 3) is suitably secured to one end of a tubing 108 which is of a sufficiently greater length than the length of the liner 32 for permitting a reciprocation of the head 10 therein as hereinbefore set forth. The opposite end of the tubing 108 extends into the open end of a larger diameter tubing 110 having a suitable pack-off gland 112 interposed therein as is well known. The tubing 110 is supported in a substantially horizontal position by suitable spaced support members 114 and 116 and is disposed in substantial axial alignment with the liner 32. A suitable steam fitting 118 is secured to the opposite end of the tubing 110 by the usual swadge 120 and a stuffing box 122 of any well known type is secured to the fitting 118 in substantial alignment with the tubing 110. A polished rod 124 or the like extends through the packing head or stuffing box 122 and into connection with the tubing 108 in any well known manner (not shown) in order to reciprocate the tubing 108 and steam head 10 as will be hereinafter set forth. Of course, a suitable cage member (not shown) is provided on the end of the tubing 108 oppositely disposed from the steam head or interposed therein, as desired, and the pack-off gland restricts or closes the annulus between the tubing 108 and 110 for a purpose as will be hereinafter set forth. A steam conduit 126 is in communication with the interior of the steam fitting 118 through a suitable valve 128, which is preferably a gate valve, but not limited thereto, and a suitable bleeder line 130 having a suitable valve 132 interposed therein is also in communication with the interior of the fitting 118.

The clogged liner 32 may be secured on the supports 104 and 106 for receiving the steam head 10 therein. Steam may be admitted into the tubing 110 through the line 126 in the usual manner whereby the steam is directed longitudinally through the tubing 110 and diverted through the cage member (not shown) into the interior of the tubing 108. The steam in the tubing 108 is directed to the steam head 10 as hereinbefore set forth and is jettisoned or ejected from the head against the inner periphery of the liner 32. The tubing 108 may be reciprocated by the polished rod 124 in the usual manner (not shown) for reciprocating the head 10 within the liner 32 in the manner as hereinbefore set forth. It is preferable to reciprocate the head several times through a relatively short interval of length until the adjacent area of the liner 32 has been cleaned by the steam. The head 10 may then be reciprocated through a second relatively short interval of length conterminous with the cleaned section until the second section has been cleaned with the reciprocation operation being repeated until the entire length of the liner 32 has been cleaned. Of course, the liner 32 may alternately be mounted on rollers (not shown) and reciprocated with respect to the steam head 10, if desired.

Subsequent to the cleaning operation, the steam may be shut off from the tubing 110 and the cleaned liner 32 may be removed for return to service.

Of course, it will be apparent that substantially any fluid may be directed to the interior of a well bore in the manner as hereinbefore set forth and by the heat 10 for treatment of the inner periphery thereof, such as acidizing fluids, solvents, clay stabilizing fluids, and the like. In addition, suitable chemical additives may be introduced into the steam stream, if desired.

From the foregoing it will be apparent that the present invention provides a novel method and means for steamcleaning liners in producing oil well bores or the like. The novel steam head comprises a substantially horn-shaped surface disposed in spaced relation to a substantially flat surface to provide a radial steam passageway having a substantially constant cross sectional area or volume in order to maintain the high temperature and high pressure of the steam column until just before the steam is jetted or ejected from the head and impinged against the inner periphery of the liner. The novel method comprises initially removing the production equipment from the well bore, lowering the steam head into the liner by means of concentrically arranged tubing strings and reciprocating the steam head selectively within the liner by raising and lowering one string with respect to the other. Alternately, the steam head may be lowered into the well bore by a tubing string and reciprocated within the liner by means of a wire line. Subsequent to the cleaning operation the cleaning equipment may be removed from the well bore, the normal production equipment may be reinstalled therein and production of well fluid may be continued in the normal manner.

Whereas the present invention has been described in particular relation to the drawings attached hereto, it should be understood that other and further modifications, apart from those shown or suggested herein, may be made within the spirit and scope of this invention.

What is claimed is:

1. A method of steam cleaning a subsurface liner in a producing well bore having production equipment therein and comprising removing of the production equipment from the well bore, connecting a steam head to the lower end of a first tubing string, lowering the first tubing string and stream head into the well bore, landing the first tubing string with the lower end thereof spaced above the upper end of the liner, lowering connecting means through the first tubing string, connecting said connecting means with the steam head, disconnecting the steam head from the first tubing string, lowering the steam head into the interior of the liner, introducing steam at high pressure and high temperature into the interior of the first tubing string, diverting the steam into the interior of the steam head, directing the steam radially outwardly from the steam head during lowering thereof in said liner for impinging against the inner periphery of the liner, maintaining the steam at substantially constant volume during said radial directing thereof for maintaining high temperature and high pressure for discharge of the steam from the steam head at high temperature and high pressure, and directing the spent stream upwardly in the wall bore around the first tubing string for discharge from the well bore, elevating the steam head to the lower end of the first tubing string, connecting the steam head with the first tubing string, disconnecting the connecting means from the steam head, and raising the tubing string and steam head for removal thereof from the well bore.

2. A method as set forth in claim 1 wherein the connecting means is lowered by a second tubing string, and the diverted steam is directed through the second tubing string to the steam head.

3. A method as set forth in claim 1 wherein the connecting means is lowered by a wire line.

4. A method as set forth in claim 1 including the step of selectively reciprocating the steam head within the liner during the ejection of steam therefrom.

5. A method as set forth in claim 4 wherein the steam head is reciprocated by a wire line.

6. A method as set forth in claim 4 wherein the steam head is reciprocated by a second tubing string.

* * * * *